US008591984B2

(12) United States Patent
Tsai et al.

(10) Patent No.: US 8,591,984 B2
(45) Date of Patent: Nov. 26, 2013

(54) FABRICATING METHOD OF ELECTRON-EMITTING DEVICE

(75) Inventors: Chih-Hao Tsai, Changhua County (TW); Kuan-Jung Chen, Taipei County (TW); Fu-Ming Pan, Hsinchu County (TW); Mei Liu, Pingtung County (TW); Chi-Neng Mo, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 164 days.

(21) Appl. No.: 13/118,558

(22) Filed: May 30, 2011

(65) Prior Publication Data

US 2011/0229630 A1 Sep. 22, 2011

Related U.S. Application Data

(62) Division of application No. 11/964,014, filed on Dec. 25, 2007, now Pat. No. 7,986,080.

(30) Foreign Application Priority Data

Jul. 17, 2007 (TW) ..... 96125965 A

(51) Int. Cl.
*B05D 5/12* (2006.01)

(52) U.S. Cl.
USPC ..... 427/78

(58) Field of Classification Search
USPC ..... 313/294, 448, 449; 427/78
See application file for complete search history.

(56) References Cited

U.S. PATENT DOCUMENTS

2006/0240180 A1 * 10/2006 Yamada et al. ..... 427/77

* cited by examiner

*Primary Examiner* — Nimeshkumar Patel
*Assistant Examiner* — Jacob R Stern
(74) *Attorney, Agent, or Firm* — Jianq Chyun IP Office

(57) ABSTRACT

A fabricating method of an electron-emitting device includes at least the following steps. A substrate having a first side and a second side is provided. The first side is opposite to the second side. A first electrode pattern layer is formed on the first side of the substrate. A conductive pattern layer is formed on the substrate and the first electrode pattern layer, and the conductive pattern layer partially covers the first electrode pattern layer. An electron-emitting region is formed in the conductive pattern layer. A second electrode pattern layer is formed on the second side of the substrate. The second electrode pattern layer partially covers the conductive pattern layer. The fabricating method has a simple fabricating process and a low fabricating cost.

15 Claims, 5 Drawing Sheets

FABRICATING METHOD OF ELECTRON-EMITTING DEVICE

CROSS-REFERENCE TO RELATED APPLICATION

This application is a divisional of and claims the priority benefit of U.S. patent application Ser. No. 11/964,014, filed on Dec. 25, 2007, now allowed, which claims the priority benefit of Taiwan patent application serial no. 96125965, filed on Jul. 17, 2007. The entirety of each of the above-mentioned patent applications is hereby incorporated by reference herein and made a part of this specification.

BACKGROUND OF THE INVENTION

1. Field of the Invention

The invention relates to a fabricating method of an electron source device. More particularly, the invention relates to a fabricating method of an electron-emitting device.

2. Description of Related Art

The field emission display (FED) is a flat panel display technology similar to the conventional cathode ray tube (CRT) display. The principle of the FED is briefly described as follows. First, under the induction of an electric field, a plurality of juxtaposed electron source devices (on a cathode side) would emit electrons. Afterwards, the electrons are attracted and accelerated by an anode to bombard phosphor powder on the anode surface so as to emit a fluorescent light. Next, the fluorescent light would penetrate the anode, emit from a back surface thereof and display an image on the back surface of the anode (a front surface of a display panel).

According to different modes of electron emission, electron source devices can be classified into spindt, surface conduction electron-emitting device (SED), carbon nanotube (CNT), ballistic electron surface emitting display (BSD) and the like.

FIG. 1 schematically illustrates a top view of a conventional electron-emitting device. FIG. 2 schematically illustrates a cross-sectional view of FIG. 1 along the line A-A'. Referring to both FIGS. 1 and 2, an electron-emitting device 100 is constituted by a substrate 1, a first electrode 2, a second electrode 3 and a conductive thin film 4. The conductive thin film 4 has a slit 5 thereon.

Still referring to FIG. 2, a fabricating method of the electron-emitting device 100 has the following steps. First, a substrate 1 is provided. Next, a pair of a first electrode 2 and a second electrode 3 is formed on the substrate 1. Afterwards, the conductive thin film 4 is formed by an ink jet technique between the first electrode 2 and the second electrode 3. Then, a pulse voltage is applied between the first electrode 2 and the second electrode 3 so as to deoxidize the conductive thin film 4 and form the slit 5. The step is called a slit-forming process.

At this moment, since a width of the slit 5 is still within a sub-micrometer scale, electrons cannot be emitted from a surface of the conductive thin film 4 through a quantum tunnel effect when an electric field is applied. Therefore, an activation process has to be further performed to render the slit 5 as a nanometer scale slit.

More specifically, in the activation process, an organic gas containing carbon elements is induced to the slit 5. Furthermore, through application of a pulse voltage, the organic gas is decomposed into carbon elements and deposited on a periphery of the slit 5 in the sub-micrometer scale so that the slit 5 is further formed as the slit 5 in a nanometer scale.

In light of the above-mentioned, a conventional fabricating method of the conventional electron-emitting device 100 at least requires two steps—a slit-forming process and an activation process—so as to form a nanometer scale slit. Moreover, when forming the conductive thin film 4 by an ink-jet technology, a conductive solution containing nanometer scale conductive particles is required. Hence, an additional polishing process is required to prepare the conductive solution. In other words, the conventional fabricating method of the electron-emitting device 100 is complicated and a fabricating cost thereof is difficult to be reduced.

Particularly, when the conductive thin film 4 is formed by an ink jet technology, a complicated ink jet control mechanism is required as well. Therefore, if the electron-emitting devices 100 are fabricated in a large area, a yield thereof is difficult to be increased.

SUMMARY OF THE INVENTION

In view of the aforementioned, the invention provides a fabricating method of an electron-emitting device, which can simplify the fabricating process and reduce the fabricating cost thereof. Moreover, fabrication of the electron-emitting device can be executed in a large area so as to improve the yield.

In view of the foregoing, the invention provides a fabricating method of an electron-emitting device. First, a substrate is provided having a first side and a second side which is opposite to the first side. Afterwards, a first electrode pattern layer is formed on the first side of the substrate. Next, a conductive pattern layer is formed on the substrate and the first electrode pattern layer. The conductive pattern layer partially covers the first electrode pattern layer. Then, an electron-emitting region is formed in the conductive pattern layer. A second electrode pattern layer is formed on the second side of the substrate. The second electrode pattern layer partially covers the conductive pattern layer.

According to one embodiment of the invention, there is a segmented step on an edge of the conductive pattern layer covering the first electrode pattern layer. The electron-emitting region is formed at the segment step in the conductive pattern layer.

According to one embodiment of the invention, a reactant gas is first provided so as to expand a volume of the conductive pattern layer in a process of forming the electron-emitting region. Afterwards, the reactant gas is removed so that the volume the conductive pattern layer is shrunk. The reactant gas is selected from, for example, hydrogen, methane, hydrocarbon and any combination of the foregoing. Moreover, a pressure of the reactant gas is, for example, 0-100 bar.

According to one embodiment of the invention, a temperature during the process of forming the electron-emitting region is, for example, 50K-1,273K.

According to one embodiment of the invention, the electron-emitting region may be a slit. A width of the slit is 5-1,000 nanometers (nm).

According to one embodiment of the invention, the substrate is fabricated using glass or silicon.

According to one embodiment of the invention, before forming the first electrode pattern layer, the fabricating method further includes forming an insulating layer on the substrate. The insulating layer is fabricated using a material such as silicon dioxide or aluminum-oxide.

According to one embodiment of the invention, a material of the first electrode pattern layer and the second electrode pattern layer may be selected from platinum (Pt), tantalum (Ta), titanium (Ti), aluminum (Al), copper (Cu), silver (Ag), gold (Au) and any combination of the foregoing.

According to one embodiment of the invention, a material of the conductive pattern layer is selected, for example, from palladium (Pd), platinum (Pt), gold (Au), tungsten (W), rhodium (Rh), iridium (Ir), aluminum (Al), titanium (Ti), vanadium (V), gallium (Ga), yttrium (Y), zirconium (Zr), niobium (Nb), molybdenum (Mo), silver (Ag), cadmium (Cd), tin (Sn), tantalum (Ta), lanthanum (La), cerium (Ce), neodymium (Nd), gadolinium (Gd) and any metal oxides, metal nitrides, metal complex oxides and metal complex alloys of the foregoing.

According to one embodiment of the invention, the fabricating method of the electron-emitting device further includes forming an adhesion layer in at least one of the following three locations, between the substrate and the first electrode pattern layer, between the substrate and the second electrode pattern layer, or between the conductive pattern layer and the second electrode pattern layer. A material of the adhesion layer is selected, for example, from titanium (Ti), titanium nitride (TiN), tantalum (Ta), tantalum nitride (TaN) and any combination of the foregoing.

In the invention, the conductive pattern layer covering the first electrode pattern layer is rendered having a segmented step on the edge. The volume of the conductive pattern layer is expanded and shrunk by inducing and extracting hydrogen therein respectively. Consequently, an internal stress is generated in the segmented step, which ruptures the conductive pattern layer to form a slit. Hence, the invention has the advantages of a simple fabricating process and a low fabricating cost. In addition, the first electrode pattern layer, the second electrode pattern layer, the conductive pattern layer are fabricated by a mature physical/chemical vapor deposition (PVD/CVD) process and a photolithographic etching process such that the fabrication of the electron-emitting device can be executed in a large area. Further, the electron-emitting device has a simple structure easy to fabricate.

In order to make the aforementioned and other features and advantages of the invention more comprehensible, embodiments accompanied with figures are described in detail below.

DESCRIPTION OF EMBODIMENTS

FIGS. 3A through 3E schematically illustrate a process flowchart of a fabricating method of an electron-emitting device according to one embodiment of the invention. Please refer to FIGS. 3A through 3E in sequence.

Figure 1:
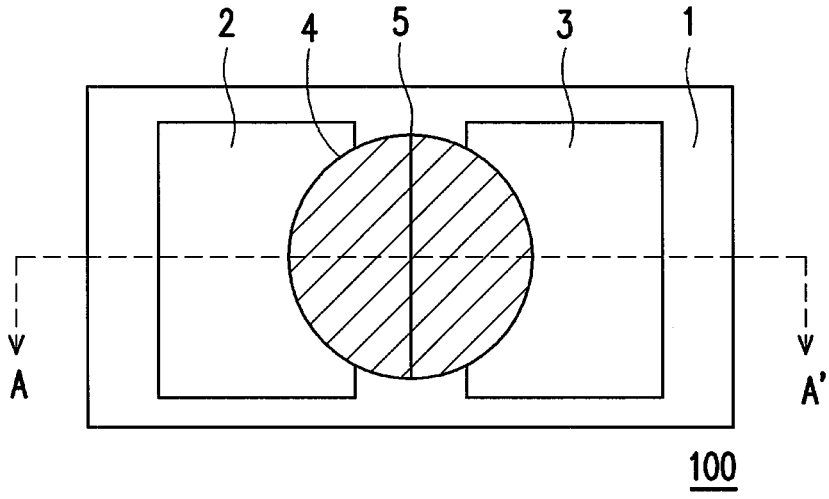
FIG. 1 (PRIOR ART)
FIG. 1 schematically illustrates a top view of a conventional electron-emitting device.
Figure 2:
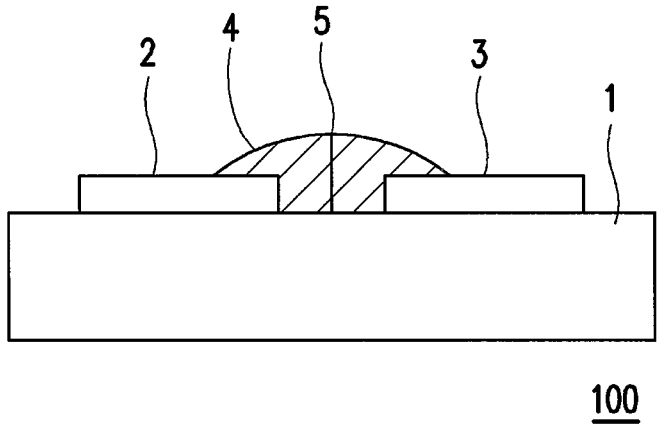
FIG. 2 (PRIOR ART)
FIG. 2 schematically illustrates a cross-sectional view of FIG. 1 along the line A-A'.
Figure 3A:
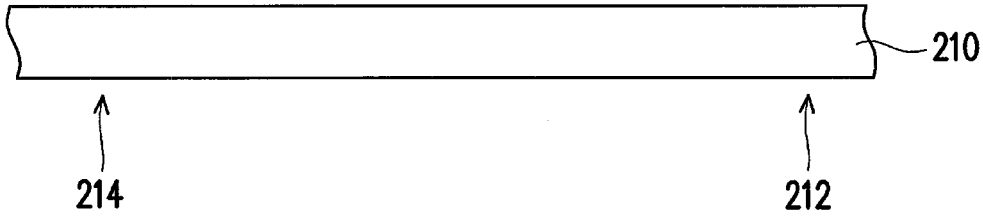
FIGS. 3A through 3E schematically illustrate a process flowchart of a fabricating method of an electron-emitting device according to one embodiment of the invention.

First, referring to FIG. 3A, a substrate 210 is provided. The substrate 210 has a first side 212 and a second side 214 which is opposite to the first side 212. The substrate 210 is fabricated using glass or silicon, for example.

Figure 3B:
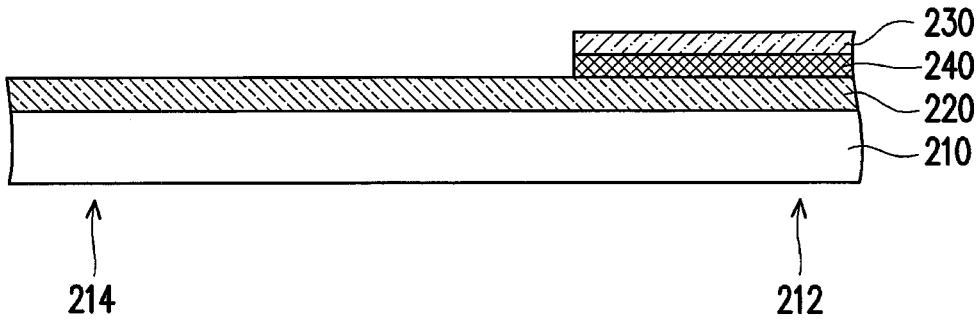

Afterwards, referring to FIG. 3B, a first electrode pattern layer 230 is formed on the first side 212 of the substrate 210. A material of the first electrode pattern layer 230 is selected from, for example, platinum (Pt), tantalum (Ta), titanium (Ti), aluminum (Al), copper (Cu), silver (Ag), gold (Au) and any alloy of the foregoing. A method for forming the first electrode pattern layer 230 may include the following steps. First, a conductive thin film (not illustrated) is deposited by a physical/chemical vapor deposition (PVD/CVD) process, and then the first electrode pattern layer 230 having a certain pattern is formed by a photolithographic etching process. The PVD process may be a well-known method, such as an ion sputtering process, an electron gun evaporation process or a plasma enhanced CVD process. And, the photolithographic etching process is also a well-known method, so descriptions thereof are omitted herein.

According to one embodiment of the invention, before forming the first electrode pattern layer 230, the fabricating method further includes forming an insulating layer 220 on the substrate 210. In other words, when the substrate 210 is a conductive substrate, the insulating layer 220 can be used for insulation. The insulating layer 220 is fabricated using a material such as silicon dioxide or aluminum oxide. More specifically, when silicon is used as a material for the substrate 210, a high temperature furnace tube oxidation method can be directly applied to oxidize a surface of the substrate 210 so as to form a silicon dioxide layer as the insulating layer 220.

Particularly, in another embodiment of the invention, before forming the first electrode pattern layer 230, an adhesion layer 240 may be first formed on the substrate 210. The adhesion layer 240 is between the substrate 210 and the first electrode pattern layer 230. A material of the adhesion layer 240 is selected, for example, from titanium (Ti), titanium nitride (TiN), tantalum (Ta), tantalum nitride (TaN) and any combination of the foregoing. Consequently, adhesion of the first electrode pattern layer 230 to the substrate 210 can be increased.

Figure 3C:
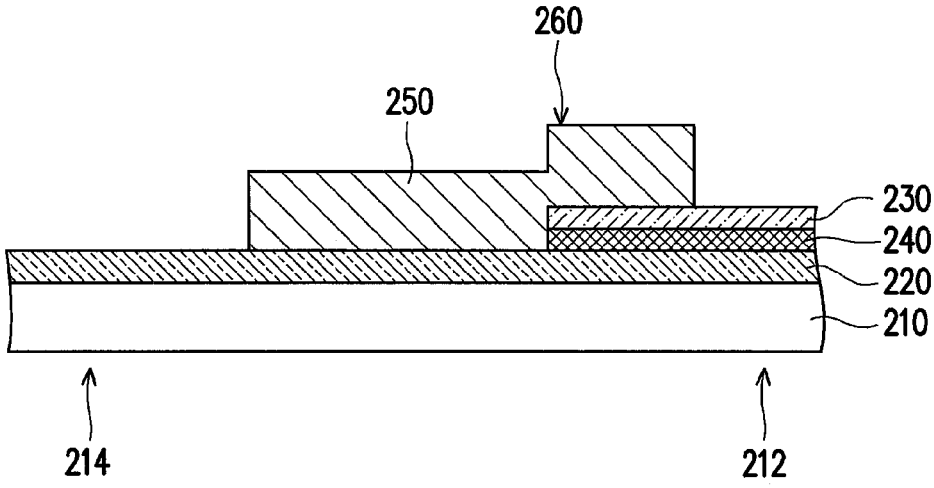

Next, referring to FIG. 3C, a conductive pattern layer 250 is formed on the substrate 210 and the first electrode pattern layer 230. The conductive pattern layer 250 partially covers the first electrode pattern layer 230. According to one embodiment of the invention, a segmented step 260 is on an edge of the conductive pattern layer 250 covering the first electrode pattern layer 230. A material of the conductive pattern layer 250 is selected, for example, from palladium (Pd), platinum (Pt), gold (Au), tungsten (W), rhodium (Rh), iridium (Ir), aluminum (Al), titanium (Ti), vanadium (V), gallium (Ga), yttrium (Y), zirconium (Zr), niobium (Nb), molybdenum (Mo), silver (Ag), cadmium (Cd), tin (Sn), tantalum (Ta), lanthanum (La), cerium (Ce), neodymium (Nd), gadolinium (Gd) and any metal oxides, metal nitrides, metal complex oxides and metal complex alloys of the foregoing. Particularly, with a design of the segmented step 260, an electron-emitting region 252 is easy to be formed in the subsequent fabricating process.

Figure 3D:
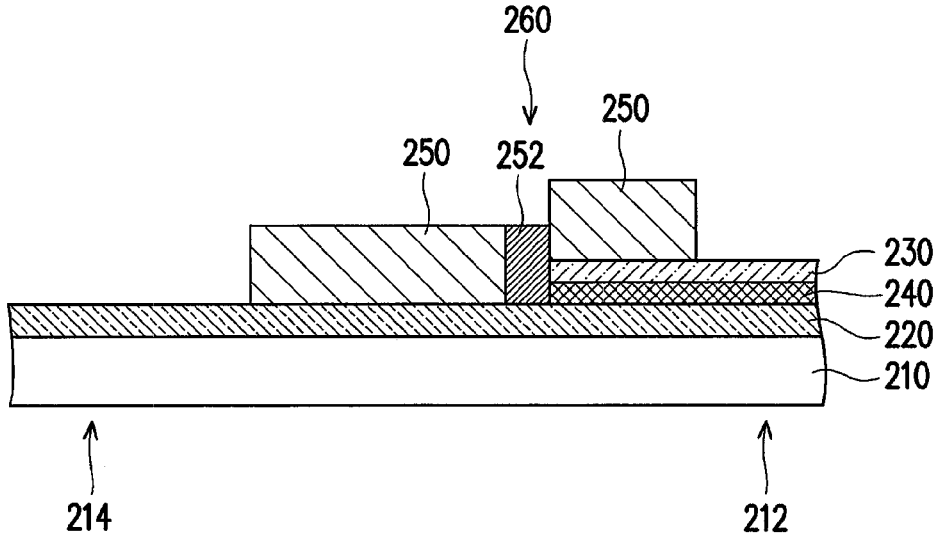

Afterwards, referring to FIG. 3D, the electron-emitting region 252 is formed in the conductive pattern layer 250. According to one embodiment of the invention, the electron-emitting region 252 is formed in the conductive pattern layer 250 at the segmented step 260. A fabricating method for forming the electron-emitting region 252 may include the following steps. First, a reactant gas (not illustrated) is provided to expand a volume of the conductive pattern layer 250. Afterwards, the reactant gas is removed so that the volume of the conductive pattern layer 250 is shrunk. The reactant gas is selected from, for example, hydrogen ($H_2$), methane ($CH_4$), hydrocarbon and any combination of the foregoing. Moreover, a pressure of the reactant gas is, for example, 0-100 bar.

Additionally, a temperature during the fabricating process of forming the electron-emitting region 252 is, for example, 50K-1,273K.

In view of the aforementioned, pressures of different reactant gases and a temperature of the reactant environment are controlled so as to make the reactant gas react with the conductive pattern layer 250. It is assumed that the material of the conductive pattern layer 250 is palladium (Pd) and the reactant gas is hydrogen as an example to facilitate illustration. When hydrogen atoms enter a crystal structure formed by Pd atoms, the reacted crystal structure will be enlarged. Alternatively speaking, the volume of the conductive pattern layer 250 is expanded. Afterwards, when the hydrogen is removed, the hydrogen atoms previously existing in the crystal structure formed by Pd atoms are released to the outside environment according to the principle of reversible chemical equilibrium. Therefore, the volume of the conductive pattern layer 250 is shrunk so as to revert to the original volume.

Different material types and thicknesses of the film layers along with the expansion and shrinking of the conductive pattern layer 250, an enormous internal stress would be generated at the segmented step 260 in the conductive pattern layer 250. Hence, the conductive pattern layer 250 would rupture at the segmented step 260 so as to form a slit as the electron-emitting region 252. The electron-emitting region 252 may be a nano scale slit, and a width of the slit is 5-1,000 nm, for example.

Figure 4:
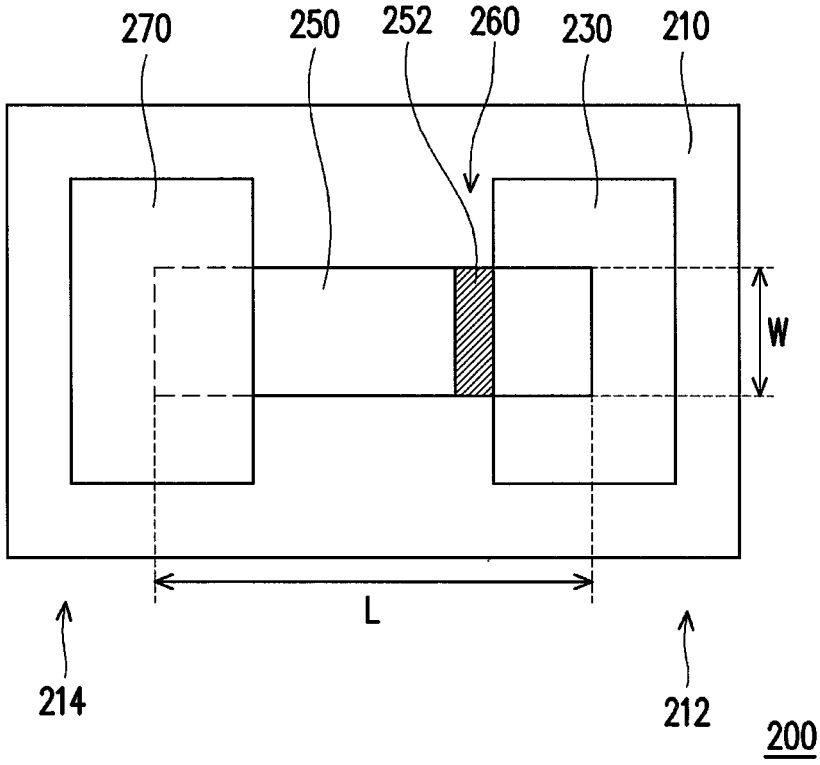
FIG. 4 schematically illustrates a side view of an electron-emitting device according to one embodiment of the invention.

Thicknesses of each of the above-mentioned film layers may be as follows. The thickness of the adhesion layer 240 between the substrate 210 and the first electrode pattern layer 230 is, for example, around 5 nm. The thickness of the first electrode pattern layer 230 is around 10-1,000 nm. The thickness of the conductive pattern layer 250 is around 20-1,000 nm, a length L is around 50 μm and a width W is around 3 μm, as illustrated in FIG. 4.

Figure 3E:
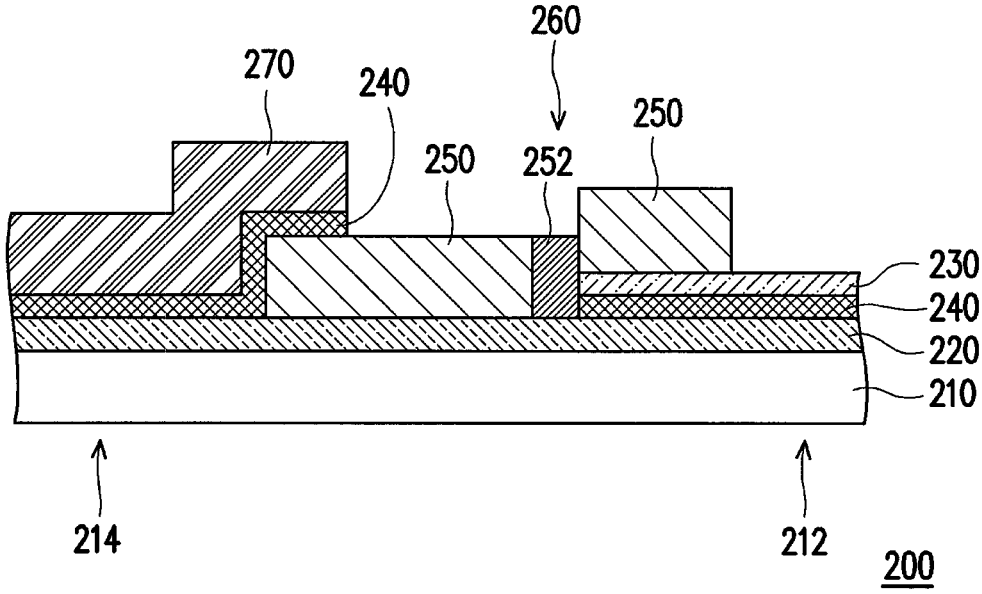

Next, referring to FIG. 3E, a second electrode pattern layer 270 is formed on the second side 214 of the substrate 210. The second electrode pattern layer 270 partially covers the conductive pattern layer 250. According to one embodiment of the invention, a material of the second electrode pattern layer 270 is selected from, for example, Pt, Ta, Ti, Al, Cu, Ag, Au and any alloy of the foregoing. In addition, a thickness of the second electrode pattern layer 270 is, for example, 10-1,000 nm. Through the process illustrated in FIGS. 3A through 3E, the fabrication of the electron-emitting device 200 has been completed as shown in FIG. 3E.

Furthermore, according to another embodiment of the invention, before forming the second electrode pattern layer 270, the adhesion layer 240 may also be formed first on the substrate 210 and a portion of the conductive pattern layer 250. The adhesion layer 240 is disposed between the substrate 210 and the second electrode pattern layer 270 or between the conductive pattern layer 250 and the second electrode pattern layer 270. A material of the adhesion layer 240 is selected from, for example, Ti, TiN, Ta, TaN and any combination of the foregoing. The thickness of the adhesion layer 240 is, for example, around 5 nm. Adhesion of the second electrode pattern layer 270 to the conductive pattern layer 250 and the substrate 210 can be thus increased.

In brief, the fabricating method of the electron-emitting device 200 only requires one step (the step as illustrated in FIG. 3D) to form a nano scale slit (i.e., the electron-emitting region 252), and therefore has an advantage of a simple fabricating process.

Moreover, the method for forming the first electrode pattern layer 230, the conductive pattern layer 250, the adhesion layer 240 and the second electrode pattern layer 270 may be a conventional physical/chemical vapor deposition (PVD/CVD) process and a photolithographic etching process. Accordingly, the electron-emitting device 200 can be fabricated in a large area. Furthermore, a location where each of the film layers is formed on the substrate 210 can be accurately controlled and may form any required pattern.

Compared with a conventional method for fabricating the conductive thin film 4 by a jet ink technique, the fabricating method of the electron-emitting device 200 does not require a jet ink control mechanism. Accordingly, when the electron-emitting device 200 is fabricated in a large area, superior productivity can be achieved. The electron-emitting device 200 is briefly described in the following.

FIG. 4 schematically illustrates a top view of an electron-emitting device according to one embodiment of the invention. Referring to both FIGS. 4 and 3E, the electron-emitting device 200 includes a substrate 210, a first electrode pattern layer 230, a conductive pattern layer 250 and a second electrode pattern layer 270. The substrate 210 has a first side 212 and a second side 214 which is opposite to the first side 212. The first electrode pattern layer 230 is disposed on the first side 212 of the substrate 210. The conductive pattern layer 250 is disposed on the first electrode pattern layer 230 and partially covers the first electrode pattern layer 230. The conductive pattern layer 250 has an electron emitting region 252. The second electrode pattern layer 270 is disposed on the second side 214 of the substrate 210 and partially covers the conductive pattern layer 250.

Particularly, a segmented step 260 is on an edge of the conductive pattern layer 250 covering the first electrode pattern layer 230. The electron-emitting region 252 is disposed at the segmented step 260 in the conductive pattern layer 250. Since the conductive pattern layer 250 of the electron-emitting device 200 is located on the first electrode pattern layer 230 and the second electrode pattern layer 270 is located on the conductive pattern layer 250, i.e., the first electrode pattern layer 230, the conductive pattern layer 250, and the second electrode pattern layer 270 are partially stacked in this order on the substrate 210. Therefore, the electron-emitting region 252 may be first formed at the segmented step 260 of the conductive pattern layer 250 when only the conductive pattern layer 250 and the first electrode pattern layer 230 are formed. Afterwards, the second electrode pattern layer 270 is further formed to cover the conductive pattern layer 250. Such a structure is simpler and easier to fabricate.

According to one embodiment of the invention, the electron-emitting region 252 is, for example, a slit. A width of the slit is 5-1,000 nm. Furthermore, a material of the substrate 210 is, for example, glass or silicon. An insulating layer 220 may be further disposed on the substrate 210. A material of the insulating layer 220 is, for example, silicon dioxide or aluminum oxide.

Moreover, the electron-emitting device 200 may further include an adhesion layer 240. The adhesion layer 240 is disposed in at least one of the following three locations, between the substrate 210 and the first electrode pattern layer 230, between the substrate 210 and the second electrode pattern layer 270, or between the conductive pattern layer 250 and the second electrode pattern layer 270. A material of the adhesion layer 240 is selected from titanium (Ti), titanium nitride (TiN), tantalum (Ta), tantalum nitride (TaN) and any combination of the foregoing, for example. As regards the materials, thicknesses of film layers, ways of disposition and the like of the first electrode pattern layer 230, the adhesion layer 240, the conductive pattern layer 250 and the second electrode pattern layer 270 have been described in the above-mentioned with respect to FIGS. 3A through 3E, and thus are not to be reiterated herein.

In summary, the fabricating method of the electron-emitting device disclosed in the invention have at least the following advantages.

The fabricating method of the electron-emitting device has a simple fabricating process and a low production cost. And, the first electrode pattern layer, the second electrode pattern layer and the conductive pattern layer are fabricated by a mature physical/chemical vapor deposition (PVD/CVD) process and a photolithographic etching process. Therefore, the fabricating process has high accuracy and high yield. Besides, the fabrication of the electron-emitting device can be executed in a large area so as to increase productivity. Moreover, the electron-emitting device has a simple structure easy to fabricate.

Although the invention has been disclosed above by the embodiments, they are not intended to limit the invention. Anybody ordinarily skilled in the art can make some modifications and alterations without departing from the spirit and scope of the invention. Therefore, the protecting range of the invention falls in the appended claims.

What is claimed is:

1. A fabricating method of an electron-emitting device, comprising:

providing a substrate having a first side and a second side which is opposite to the first side;

forming a first electrode pattern layer on the first side of the substrate;

forming a conductive pattern layer on the substrate and the first electrode pattern layer, the conductive pattern layer partially covering the first electrode pattern layer;

forming an electron-emitting region in the conductive pattern layer after the conductive pattern layer being formed, wherein there is a segmented step on an edge of the conductive pattern layer covering the first electrode pattern layer, and the electron-emitting region is disposed at the segmented step in the conductive pattern layer; and forming a second electrode pattern layer on the second side of the substrate after the electron-emitting region being formed, the second electrode pattern layer partially covering the conductive pattern layer.

2. The fabricating method as claimed in claim 1, wherein a fabricating process of forming the electron-emitting region comprises:

providing a reactant gas to expand a volume of the conductive pattern layer; and removing the reactant gas to shrink the volume of the conductive pattern layer.

3. The fabricating method as claimed in claim 2, wherein the reactant gas is selected from hydrogen, methane, hydrocarbon and any combination of the foregoing.

4. The fabricating method as claimed in claim 2, wherein a pressure of the reactant gas is 0-100 bar.

5. The fabricating method as claimed in claim 1, wherein a temperature during a fabricating process of forming the electron-emitting region is 50K-1,273K.

6. The fabricating method as claimed in claim 1, wherein the electron-emitting region comprises a slit.

7. The fabricating method as claimed in claim 6, wherein a width of the slit is 5-1,000 nanometers (mm).

8. The fabricating method as claimed in claim 1, wherein a material of the substrate comprises glass or silicon.

9. The fabricating method as claimed in claim 1, before forming the first electrode pattern layer, further comprising forming an insulating layer on the substrate.

10. The fabricating method as claimed in claim 9, wherein a material of the insulating layer comprises silicon dioxide or aluminum oxide.

11. The fabricating method as claimed in claim 1, wherein materials of the first electrode pattern layer and the second electrode pattern layer are selected from platinum (Pt), tantalum (Ta), titanium (Ti), aluminum (Al), copper (Cu), silver (Ag), gold (Au) and any alloy of the foregoing.

12. The fabricating method as claimed in claim 1, wherein a material of the conductive pattern layer is selected from palladium (Pd), platinum (Pt), gold (Au), tungsten (W), rhodium (Rh), iridium (Ir), aluminum (Al), titanium (Ti), vanadium (V), gallium (Ga), yttrium (Y), zirconium (Zr), niobium (Nb), molybdenum (Mo), silver (Ag), cadmium (Cd), tin (Sn), tantalum (Ta), lanthanum (La), cerium (Ce), neodymium (Nd), gadolinium (Gd) and any metal oxides, metal nitrides, metal complex oxides and metal complex alloys of the foregoing.

13. The fabricating method as claimed in claim 1, further comprising forming an adhesion layer in at least one of the following three location, between the substrate and the first electrode pattern layer, between the substrate and the second electrode pattern layer, or between the conductive pattern layer and the second electrode pattern layer.

14. The fabricating method as claimed in claim 13, wherein a material of the adhesion layer is selected from titanium (Ti), titanium nitride (TiN), tantalum (Ta), tantalum nitride (TaN) and any combination of the foregoing.

15. The fabricating method as claimed in claim 1, wherein the first electrode pattern layer, the conductive pattern layer and the second electrode pattern layer are stacked in this order on the substrate, and a plurality of electrons are transported in the first electrode pattern layer and the second electrode pattern layer, and the electrons are transported into the conductive pattern layer for being emitted out from the electron-emitting region.

* * * * *